US009922658B2

(12) United States Patent
Arnold et al.

(10) Patent No.: US 9,922,658 B2
(45) Date of Patent: Mar. 20, 2018

(54) METHOD AND APPARATUS FOR INCREASING THE STRENGTH OF PHASE-BASED WATERMARKING OF AN AUDIO SIGNAL

(71) Applicant: THOMSON LICENSING, Issy les Moulineaux (FR)

(72) Inventors: Michael Arnold, Isernhagen (DE); Peter Georg Baum, Hannover (DE); Xiaoming Chen, Hannover (DE); Ulrich Gries, Hannover (DE)

(73) Assignee: Thomson Licensing (FR)

( * ) Notice: Subject to any disclaimer, the term of this patent is extended or adjusted under 35 U.S.C. 154(b) by 0 days.

(21) Appl. No.: 15/191,855

(22) Filed: Jun. 24, 2016

(65) Prior Publication Data

US 2016/0379653 A1 Dec. 29, 2016

(30) Foreign Application Priority Data

Jun. 26, 2015 (EP) ..... 15306014

(51) Int. Cl.
*G10L 19/00* (2013.01)
*G10L 21/00* (2013.01)
(Continued)

(52) U.S. Cl.
CPC ..... *G10L 19/018* (2013.01); *G10L 19/0204* (2013.01)

(58) Field of Classification Search
None
See application file for complete search history.

(56) References Cited

U.S. PATENT DOCUMENTS 6,952,774 B1 10/2005 Kirovski et al.
7,114,072 B2 * 9/2006 Seok ..... G06T 1/0028 704/E19.009
(Continued)

FOREIGN PATENT DOCUMENTS

EP 2175444 4/2010
EP 2787503 10/2014
(Continued)

OTHER PUBLICATIONS

Yamamoto et al., "Real-Time Audio Watermarking Based on Characteristics of PCM in Digital Instrument", Journal of Information Hiding and Multimedia Signal Processing, vol. 1, No. 2, Apr. 2010, pp. 59-71.
(Continued)

*Primary Examiner* — Satwant Singh
(74) *Attorney, Agent, or Firm* — Jack Schwartz & Associates, PLLC

(57) ABSTRACT

A challenge of audio watermarking systems in which an acoustic path is involved is the robustness against microphone pickup in case of surrounding noise. The strength of phase-based watermarking is increased by determining a masking threshold for a current frequency bin in a frequency/phase representation changing the phase based on that masking threshold and an allowed phase change value, calculating an allowed magnitude change value for the current frequency bin and calculating from an audio quality level value a magnitude change scaling factor for the magnitude change value, and increasing its magnitude accordingly.

9 Claims, 6 Drawing Sheets

(51) Int. Cl.
*G10L 19/018* (2013.01)
*G10L 19/02* (2013.01)

(56) References Cited

U.S. PATENT DOCUMENTS

| | | | | |
|---|---|---|---|---|
| 7,565,296 | B2 * | 7/2009 | Oh | G10L 19/018 382/100 |
| 9,305,559 | B2 * | 4/2016 | Sharma | G10L 19/02 |
| 9,401,153 | B2 * | 7/2016 | Sharma | G10L 19/018 |
| 2014/0142958 | A1 | 5/2014 | Ravi et al. | |
| 2016/0293172 | A1 * | 10/2016 | Sharma | G10L 19/02 |
| 2017/0133022 | A1 * | 5/2017 | Gurijala | G10L 19/018 |

FOREIGN PATENT DOCUMENTS

| | | |
|---|---|---|
| EP | 2881941 | 6/2015 |
| WO | WO0171960 A1 | 9/2001 |
| WO | WO2007031423 | 3/2007 |

OTHER PUBLICATIONS

Arnold et al., "A Phase-Based Audio Watermarking System Robust to Acoustic Path Propagation", IEEE Transactions on Information Forensics and Security, vol. 9, No. 3, Mar. 2014, pp. 411-425.

Arnold et al., "Robust Detection of Audio Watermarks after Acoustic Path Transmission", 12th ACM Workshop on Multimedia and Security, Rome, Italy, Sep. 9, 2010, pp. 117-126.

* cited by examiner

METHOD AND APPARATUS FOR INCREASING THE STRENGTH OF PHASE-BASED WATERMARKING OF AN AUDIO SIGNAL

This application claims the benefit, under 35 U.S.C. § 119 of European Patent Application No. 15306014.0, filed Jun. 26, 2015.

TECHNICAL FIELD

The invention relates to a method and to an apparatus for increasing the strength of phase-based watermarking of an audio signal.

BACKGROUND

A challenge of audio watermarking systems in which an acoustic path is involved is the robustness against microphone pickup. Especially in case of surrounding noise, it is very difficult to detect a watermark embedded in a watermarked signal that is played back via loudspeaker, cf. [1].

SUMMARY OF INVENTION

A problem to be solved by the invention is to improve the detection of watermark data that is embedded in a watermarked audio signal. This problem is solved by the method disclosed in claim 1. An apparatus that utilises this method is disclosed in claim 2.

Advantageous additional embodiments of the invention are disclosed in the respective dependent claims.

The invention is related to watermark detector compatible robustness increase of phase based watermarking systems. For increasing the robustness of the embedded watermark, not only phase modifications of the original audio signal are used for embedding a watermark signal, but also the magnitude of the original audio signal. The allowed change in magnitude is derived from the masking threshold, as it is the case for the phase modifications.

Especially in a noisy environment more frequency components with small magnitudes will survive the acoustic path transmission if their respective amplitudes are increased, and the masking threshold can be shifted to higher values in the watermark embedding process, e.g. by a fixed amount if the embedding process is carried out in advance. An additional masking level increase can be achieved by reducing the desired resulting audio quality level.

A further robustness improvement can be expected if the masking threshold is adapted to the surrounding noise in a real-time embedding setting, cf. [2]. I.e., when the sound pressure level (SPL) of the surrounding noise is increased, the masking threshold and the watermarking strength can be increased correspondingly.

Such increase in robustness is also obtained for other signal processing operations like lossy compression and filtering. A further advantage is that the processing is fully compatible with watermark detectors based solely on detection in the phase domain, see [3]. Therefore already deployed detectors can fully take advantage of the improvements in the embedder.

In principle, the method described is adapted for increasing the strength of phase-based watermarking of an audio signal, which watermarked audio signal is suitable for acoustic reception and watermark detection in the presence of surrounding noise, said method including:

determining a masking threshold for a phase change based watermarking of a current frequency bin in a frequency/phase representation of said audio signal, wherein said masking threshold determination is controlled by a given audio quality level value representing the audio quality following said audio signal watermarking;

determining an allowed phase change value for the phase of said current frequency bin, according to a reference angle to be embedded in that current frequency bin, which reference angle is derived from a watermark pattern;

changing the phase of said current frequency bin according to said allowed phase change value;

based on said masking threshold and said allowed phase change value, calculating an allowed magnitude change value for said current frequency bin, and calculating from the audio quality level value a magnitude change scaling factor;

calculating a scaled allowed magnitude change values from said allowed magnitude change value and said scaling factor;

increasing the magnitude of said current frequency bin by said scaled allowed magnitude change values, so as to output said current frequency bin with said changed phase and said increased magnitude.

In principle the apparatus described is adapted for increasing the strength of phase-based watermarking of an audio signal, which watermarked audio signal is suitable for acoustic reception and watermark detection in the presence of surrounding noise, said apparatus including means adapted to:

determining a masking threshold for a phase change based watermarking of a current frequency bin in a frequency/phase representation of said audio signal, wherein said masking threshold determination is controlled by a given audio quality level value representing the audio quality following said audio signal watermarking;

determining an allowed phase change value for the phase of said current frequency bin, according to a reference angle to be embedded in that current frequency bin, which reference angle is derived from a watermark pattern;

changing the phase of said current frequency bin according to said allowed phase change value;

based on said masking threshold and said allowed phase change value, calculating an allowed magnitude change value for said current frequency bin, and calculating from the audio quality level value a magnitude change scaling factor;

calculating a scaled allowed magnitude change values from said allowed magnitude change value and said scaling factor;

increasing the magnitude of said current frequency bin by said scaled allowed magnitude change values, so as to output said current frequency bin with said changed phase and said increased magnitude.

BRIEF DESCRIPTION OF DRAWINGS

Exemplary embodiments of the invention are described with reference to the accompanying drawings, which show in.

DESCRIPTION OF EMBODIMENTS

Even if not explicitly described, the following embodiments may be employed in any combination or sub-combination.

The Analysis-Synthesis Framework

Figure 1:
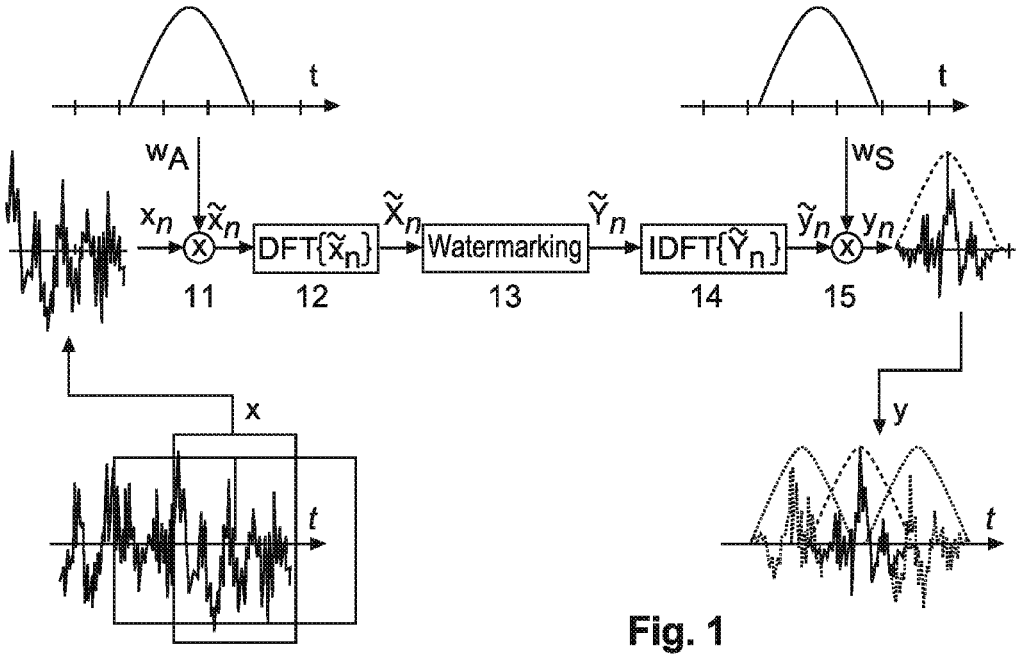
FIG. 1: Analysis-synthesis framework for audio watermark processing.

In FIG. 1, the analysis-synthesis framework for audio watermark processing is depicted. It is common practice in audio processing to apply a short-time Fourier transform (STFT) for obtaining a time-frequency representation of the signal, so as to mimic the behaviour of the human ear.

The STFT consists in (i) segmenting an input signal x in frames $x_n$ having a length of B samples using a sliding window with a hop-size of R samples and, following multiplication by an analysis window $w_A$ in a multiplier step or stage 11, (ii) applying a DFT in a transformation step or stage 12 to each frame $\tilde{x}_n$. This analysis phase results in a collection of DFT-transformed windowed frames $\tilde{X}_n$ which are fed to the subsequent watermarking processing 13 described in FIG. 9 in more detail, resulting in watermarked time domain signal frames $\tilde{Y}_n$.

At the other end, the watermarked DFT-transformed frames $\tilde{Y}_n$ output by the watermark embedding process are used to reconstruct the audio signal in a synthesis phase. The frames are inverse-transformed in an inverse transformation step or stage 14 and multiplied in a multiplier step or stage 15 by a synthesis window $w_S$ that suppresses audible artifacts by fading out spectral discontinuities at frame boundaries. The resulting frames are overlapped and added or combined with the appropriate time offset as depicted in FIG. 1.

The Watermarking Process

Figure 4:
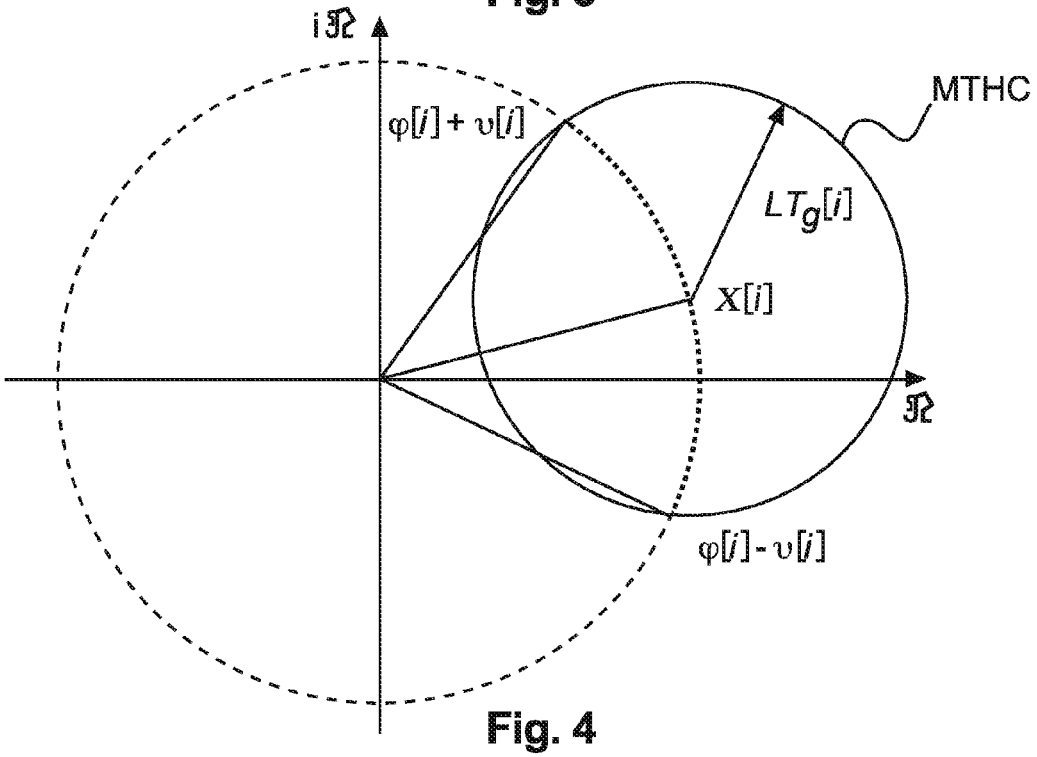
FIG. 4 Mask circle and allowed change in phase and magnitude in the grey area.

The general assumption is that watermark embedding can be performed transparently as long as watermark embedding related changes of the original audio signal are, in the frequency domain of the audio signal, located within a masking circle $LT_g$[i] of a frequency bin which has amplitude X[i], as depicted in FIG. 4.

The watermark embedding process essentially comprises:

extracting phase $\varphi_n$ and magnitude $|\tilde{X}_n|$ of the coefficients from incoming transformed frames $\tilde{X}_n$ and arranging them sequentially in two 1-D signals φ, X, applying a quantisation-based embedding processing to obtain magnitudes Y and watermarked phases ψ, segmenting the resulting signals frames $\psi_n$, $Y_n$ having a length of B-samples in order to reconstruct the watermarked transformed frames $\tilde{Y}_n$, which subsequently can be inverse-transformed back to the time domain.

It is assumed that the system embeds symbols taken from an A-ary alphabet $\mathcal{A}$, where $\theta_{a_k}$ is a sequence of angles associated with the symbol $a_k$ and derived from a reference signal $r_{a_k}$.

In general the embedding process can be written as:

$$\psi[i]=\varphi[i]+\delta\varphi[i]$$

$$Y[i]=X[i]+\delta X[i], \text{ with } a_k\in\mathcal{A},\ i\in B\cdot\mathbb{N}+0,B-1.$$

In the phase-only approach (see [1]), δX[i]=0,∀i. In order to avoid introduction of audible artifacts, the amount of phase change δφ[i]=|ψ[i]−φ[i]| has to remain below some perceptual slack ν[i]∈[0,π]. Enforcing such psycho-acoustic constraints guarantees that the introduced changes remain inaudible.

The phase change δφ[i] can be formally written as $$\delta\varphi[i]=\frac{d[i]}{|d[i]|}\min\{|d[i]|,\ v[i]\},\ i\in B\cdot\mathbb{N}+\zeta_l,\ \zeta_h,$$

where d[i]=$\theta_{a_k}$[i]−φ[i] is the forecast embedding distortion in case of perfect quantisation.

Figure 2:
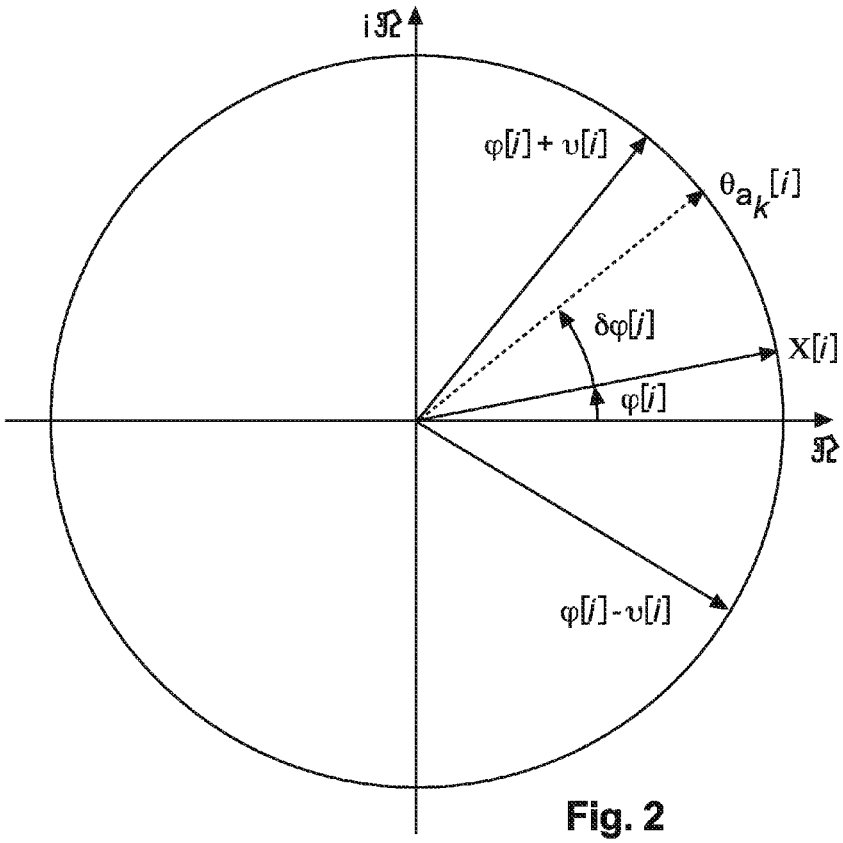
FIG. 2 Mask circle: the target angle $\theta_{a_k}$ is close enough to be reached.

In case |d[i]|≤ν[i] the reference phasor lies inside the masked region as illustrated in FIG. 2. The target angle $\theta_{a_k}$ is close enough to be reached.

Figure 3:
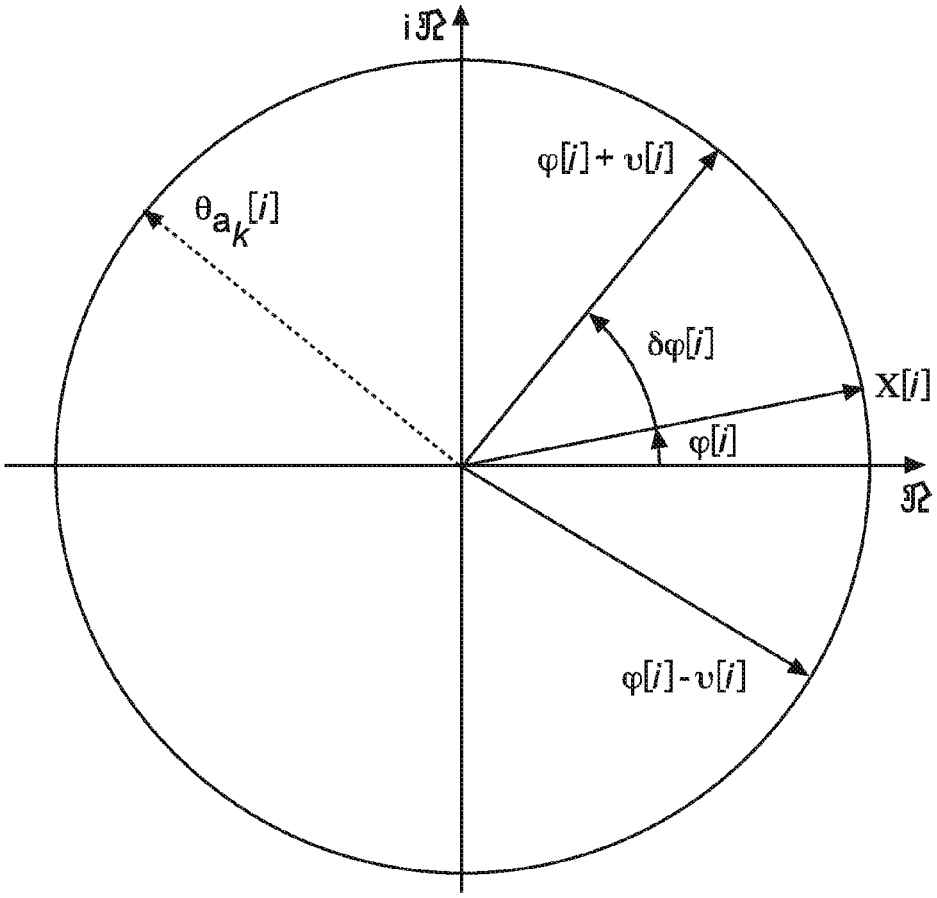
FIG. 3 Mask circle: the embedding process is bridled by the perceptual constraint.

In case |d[i]|>ν[i] the reference phasor lies outside the masked region and is depicted in FIG. 3. The embedding process is limited by the perceptual constraint.

Samples outside a specified frequency band are left untouched, i.e.

$$\psi[i]=\varphi[i],\ i\in B\cdot\mathbb{N}+\left\{0,\ \zeta_l\cup\zeta_h,\ \frac{B}{2}\right\}.$$

Angle changes for frequencies smaller than frequency tap $\zeta_l$ are discarded due to their high audibility, whereas angle changes for frequencies greater than frequency tap $\zeta_h$ are ignored because of their high variability. The indices $\zeta_l$ and $\zeta_h$ are typically set to cover a 500 Hz-11 kHz frequency band but can be changed according to the application constraints.

Masking Circle

FIG. 4 depicts the mask circle and allowed change in phase and magnitude, i.e. the masking threshold in the imaginary plane for a fixed frequency bin. Changing only the phase will restricts the phasor on the dashed-line circle with a magnitude equivalent to the original signal (dotted circle segment) whereas, according to the invention, changes in phase together with a larger magnitude extend the outer border of the masking circle by the grey circular segment. The higher the masking threshold, the larger the radius of the masking circle and the allowed range of possible changes in phase and magnitude.

For application scenarios where it is known that there is significant surrounding noise, increased masking thresholds and corresponding robustness of the watermarks can be expected. It therefore makes sense to determine the ratio r[k] of masking threshold $LT_g$[i] (loudness threshold global) relative to the original amplitude X[i]:

$$r[k]=\frac{1}{N}\sum_{j=1}^{k}\frac{LT_g[j]}{X[j]}$$

for the number of bins up to k, where N is the total number of frequency bins in signal block $\tilde{X}_n$ (see FIG. 1).

Figure 5:
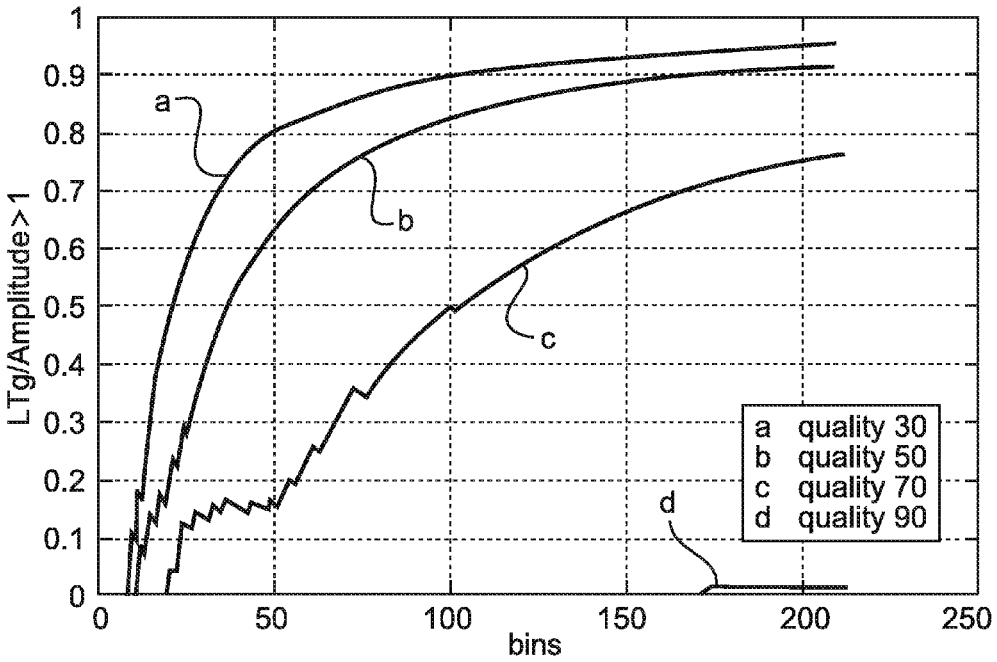
FIG. 5 Number of bins with r[i]>1 as a function of quality and highest bin number i.

For decreased-quality settings (i.e. a larger masking circle), FIG. 5 depicts the increase of the average number of frequency bins having a ratio r>1 with increasing frequency (denoted by j). In turn, the magnitude of more frequency bins will be changed to a greater degree if the quality is reduced and the upper frequency limit of the embedding range is increased.

Curve 'a' represents quality level 30, curve 'b' represents quality level 50, curve 'c' represents quality level 70, and curve 'd' represents quality level 90.

Calculate Magnitude Change

The time domain audio signal is transferred to a frequency/phase representation in which the masking threshold for each frequency bin is determined, as mentioned above. In order to calculate the allowed magnitude change in case of decreased-quality settings, the magnitude or amplitude X[i] of the masking threshold circle MTHC for phase-based watermarking of the frequency bins, the related masking threshold $LT_g[i]$ and the related change in the phase δφ[i] between the original audio signal and the reference pattern are to be determined, as depicted in FIG. 6.

The magnitude X[i] for the masking of a frequency bin in the frequency/phase representation of the audio signal and the masking threshold $LT_g[i]$ are derived from the original audio signal. The angle δφ[i] (difference between original signal and watermark signal) is determined by the watermark pattern to be embedded for the given frequency bin i, taking into account the perceptual constraints (see above).

Figure 6:
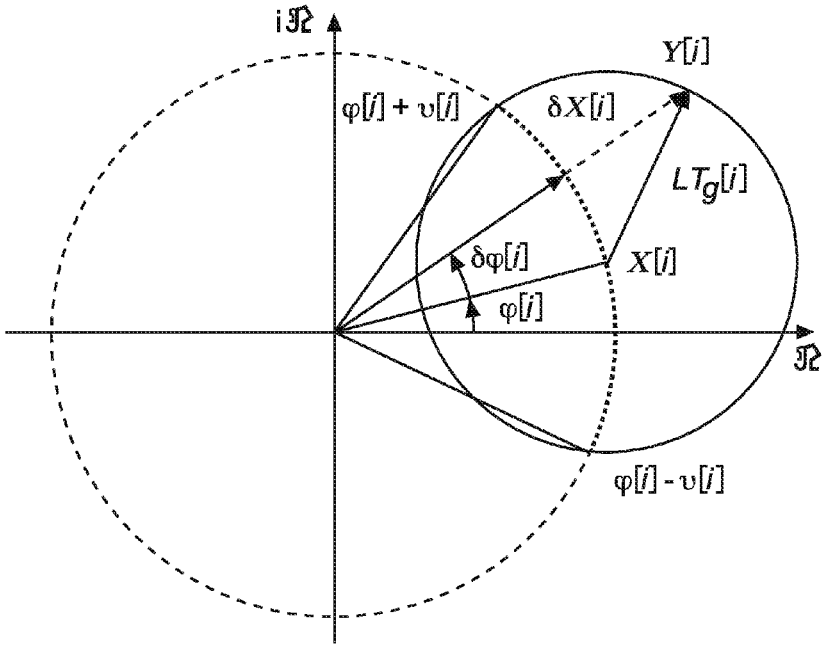
FIG. 6 Allowed magnitude change δX[i] as a function of δφ[i], $LT_g$[i] and amplitude X[i]

The allowed change in the magnitude δX[i] has to be calculated, under the constraint that the resulting marked frequency bin is still in the allowed masking segment (see FIG. 6). The change in magnitude δX[i] can be calculated from $$\delta X[i] = \sqrt{LT_g[i]^2 - 4X[i]^2\sin^2(\delta\varphi[i]/2)(1-\sin^2(\delta\varphi[i]/2))} - 2X[i]\sin^2(\delta\varphi[i]/2)$$

For implementation, the product of the X[i] cos(δφ[i]) is already calculated for the determination of the angle difference between original and reference signal.

The trigonometric identity $$\sin^2(\delta\varphi[i]/2) = \frac{1-\cos(\delta\varphi[i])}{2}$$

yields $$2X[i]\sin^2(\delta\varphi[i]/2) = X[i] - X[i]\cos(\delta\varphi[i]).$$

Therefore δX[i] can be written as $$\delta X[i] = \sqrt{LT_g[i]^2 - X[i]^2 + (X[i]\cos(\delta\varphi[i]))^2} - X[i] + X[i]\cos(\delta\varphi[i]),$$

Figure 7:
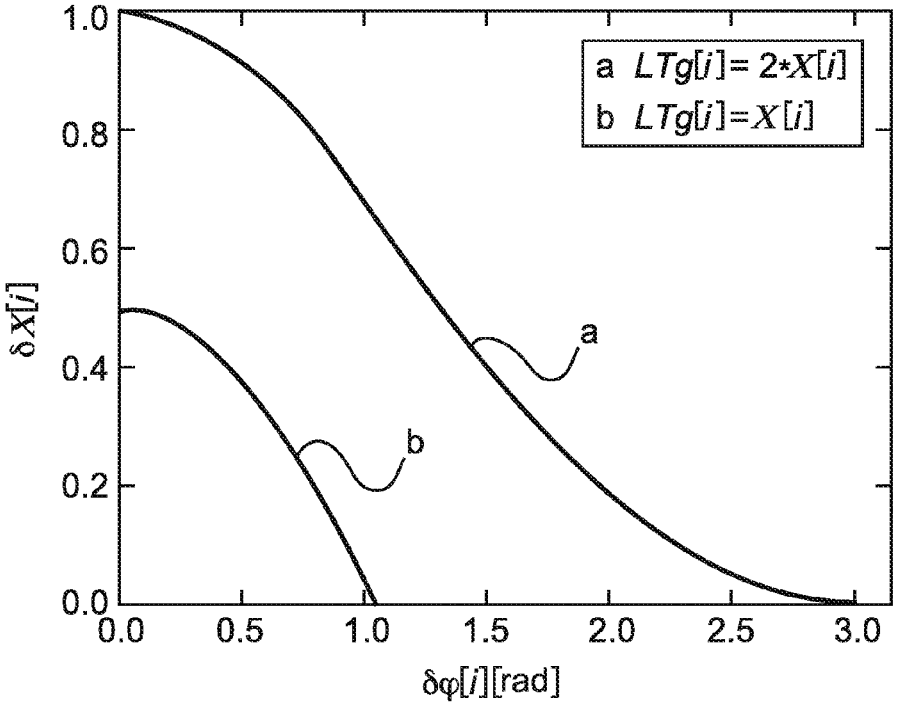
FIG. 7 Magnitude change for X[i]=½, $LT_g$[i]∈[X[i],2X[i]] as a function of δφ[i]

FIG. 7 shows examples of the dependence of the magnitude change on the angle δφ[i] for different relations between masking threshold and original amplitude. Curve 'a' represents $LT_g[i]=2X[i]$ and curve 'b' represents $LT_g[i]=X[i]$.

Adaptation for Lower Quality

The quality in the watermarking embedder is determined by a specific parameter level from best to worst defined by the range of [100, 0]. Decreasing this level by 10 units corresponds to an increase of the masking threshold by 3 dB as defined by maskingCurveOffset via $$maskingCurveOffset = \frac{100 - \text{level}}{100} \times 30 \text{ [dB]}.$$

Figure 8:
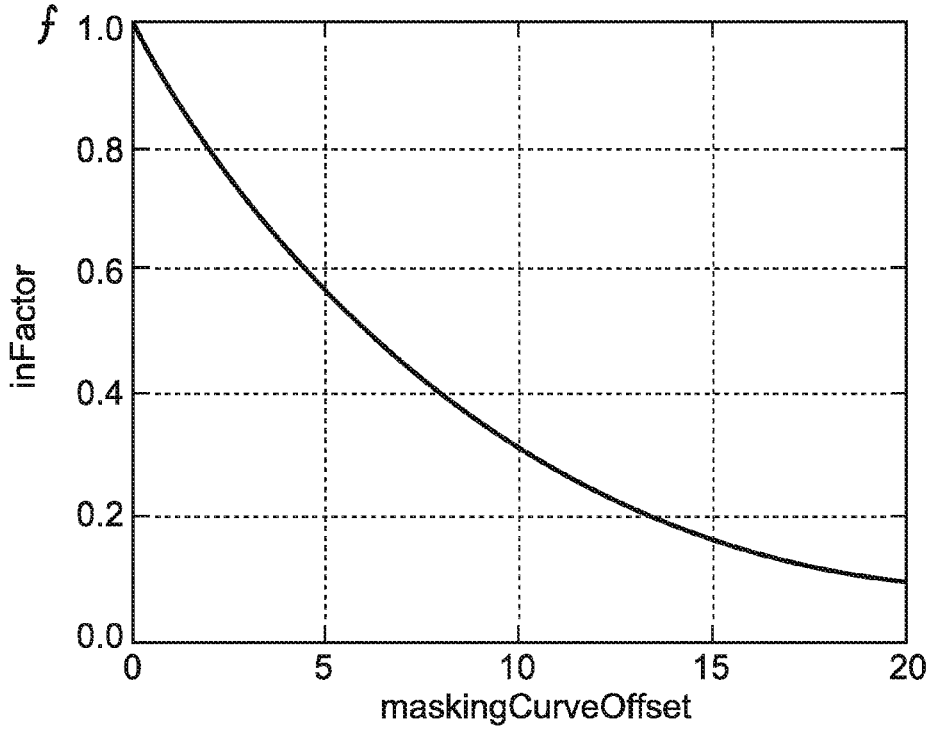
FIG. 8 Scaling of magnitude change.

In order to adapt the change in magnitude δX[i] for lower quality settings it is scaled by the factor $$f = 10^{-maskingCurveOffset/20}$$

yielding δ'X[i]=f×δX[i]. This function f is depicted in FIG. 8.

In turn, an increase of the radius $LT_g[i]$ of the masking circle (see FIG. 4)—due to the shift of the masking threshold—is reverted or reduced by the scaling of the magnitude change δX[i]. For the best quality level=100, the masking curve off set is maskingCurveOffset=0 [dB] and the magnitude change scaling factor is f=1.

Integration into the Watermark Embedder

The additional change in the magnitude X[i] of a frequency bin i in an audio block $\tilde{X}_n$ can be integrated along the phase change δφ[i]. The calculation of δ'X[i] is based on the phase change δφ[i], the masking threshold $LT_g[i]$ and the audio quality level presented above. The calculation is performed for every bin in the frequency band defined by the lower bound $\zeta_l$ and the upper bound $\zeta_h$. The embedding process is shown in FIG. 9 with the additional calculations added in the grey box 90.

Figure 9:
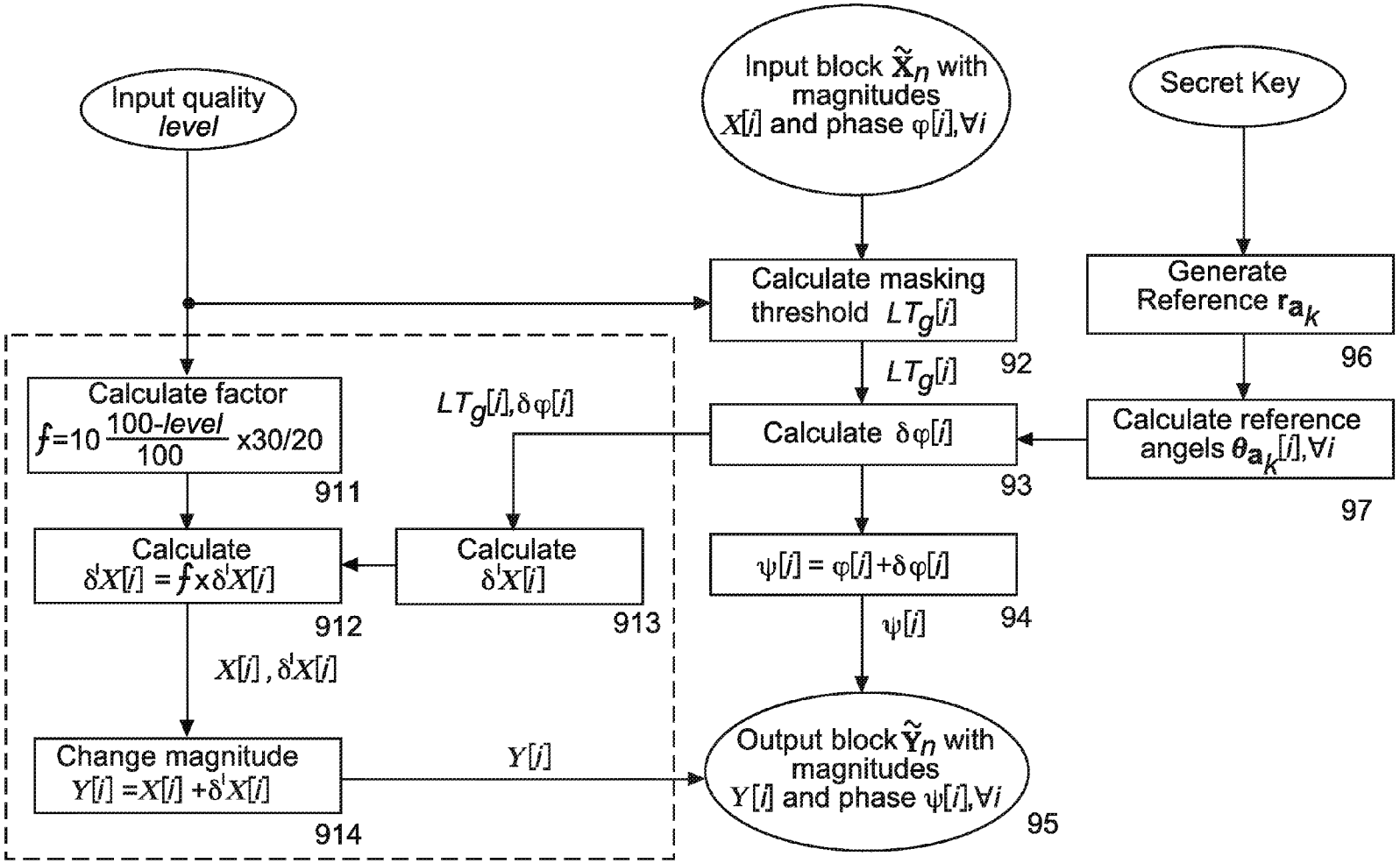
FIG. 9 Block diagram for the described processing with additional change of magnitude in parallel to the embedding into the phase.

In FIG. 9, a secret key is used to generate reference patterns in step or stage 96. These reference patterns $r_{a_k}$ are used for calculating or determining corresponding reference angles $\theta_{a_k}[i], \forall i$ in step or stage 97.

A windowed frequency domain section or block $\tilde{X}_n$ of the audio input signal (output from discrete Fourier transformation DFT 12 in FIG. 1) with its corresponding magnitude values X[i] and phase values φ[i],∀i, and a pre-determined quality level value level are input to a calculation step or stage 92 for a masking threshold $LT_g[i]$ for block $\tilde{X}_n$. This masking threshold and the reference angles $\theta_{a_k}[i], \forall i$ from step/stage 97 are used in phase angle calculating step or stage 93 for determining change angle δφ[i]. In the downstream step or stage 94 one or more phase values φ[i] are changed by δφ[i], resulting in corresponding phase values ψ[i] for the corresponding watermarked section or block $\tilde{y}_n$ of the audio signal. For more details, see e.g. [4] and [1].

For determining maximum allowable watermark magnitudes according to the processing described above, the related angle change values δφ[i], the masking threshold values $LT_g[i]$, and the above-mentioned quality level value level are input to a processing section 91. From the quality level value level a magnitude change scaling factor f is determined in step or stage 911 as described above. From the $LT_g[i]$ and δφ[i] values, corresponding allowed magnitude change values δX[i] of magnitude values X[i] are calculated in step or stage 913, and in step or stage 912 the corresponding scaled allowed magnitude change values δ'X[i] =f×δX[i] are determined. The scaled allowed magnitude change values δ'X[i] are added in step or stage 914 to the corresponding magnitude values X[i], resulting in adapted magnitude values Y[i], which represent the magnitude values of the watermarked section or block $\tilde{Y}_n$ of the audio signal. Then the corresponding magnitude values Y[i] and phase values ω[i],∀i are passed through step or stage 95 to step/stage 14 in FIG. 1.

Robustness Results

In order to verify the increase in robustness, the existing watermarking system (phase change only) was compared to the improved processing described above. In robustness tests the detection rate with different microphone positions m1, m2, m3 and m4 following an acoustic path transmission with surrounding noise present was measured.

Figure 10:
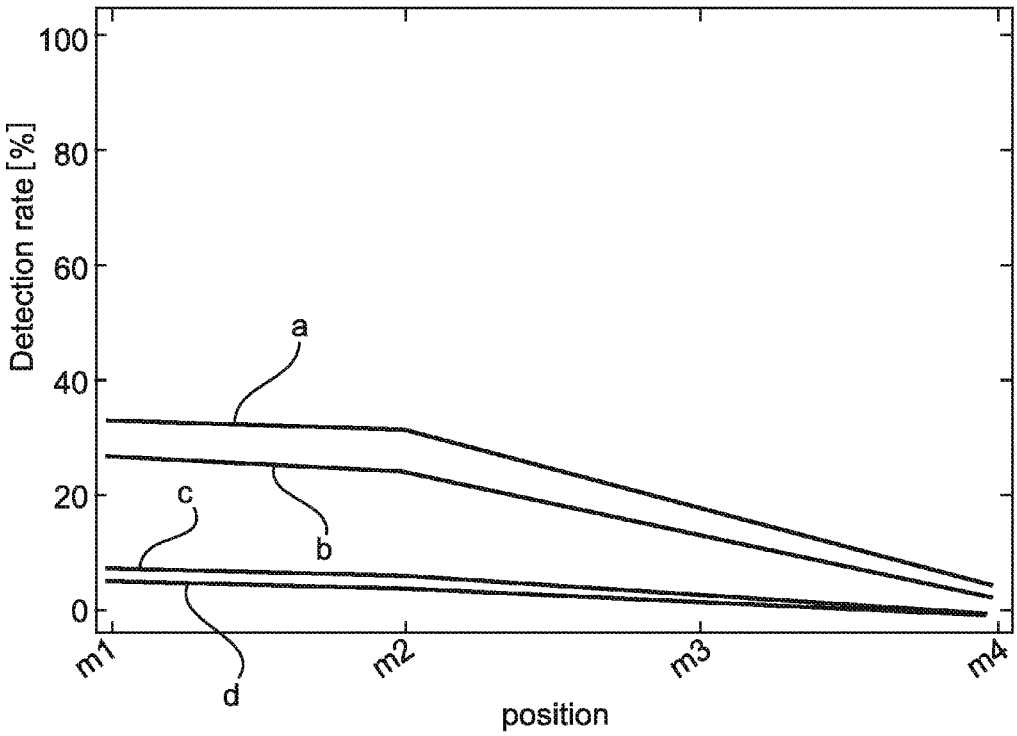
FIG. 10 Detection rate for quality level settings 100 and 80 as a function of the microphone, with phase-only and phase-and-magnitude embedding.

In FIG. 10, curve 'd' shows the average detection rate values for a phase change only watermarking system for different microphone positions m1 to m4 for a quality level=100, and curve 'b' for quality level=80.

Curve 'c' shows the average detection rate values for a phase change and magnitude change watermarking system for a quality level=100, and curve 'a' for quality level=80.

FIG. 10 shows an increase in detection rate for all microphone positions and for two different quality level settings.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

REFERENCES

[1] M. Arnold, X. M. Chen, P. Baum, U. Gries, G. Doërr, "A Phase-based Audio Watermarking System Robust to Acoustic Path Propagation", IEEE Transactions On Information Forensics and Security, vol. 9, no. 3, March 2014, pp. 411-425.

[2] PCT/EP2014/076108

[3] EP 2175444 A1

[4] WO 2007/031423 A1

What is claimed is:

1. A method for increasing the strength of phase-based watermarking of an audio signal, which watermarked audio signal is suitable for acoustic reception and watermark detection in the presence of surrounding noise, said method including:

receiving said audio signal;

determining a masking threshold for a phase change based watermarking of a current frequency bin in a frequency/phase representation of said audio signal, wherein said masking threshold determination is controlled by a received audio quality level value representing the audio quality following said audio signal watermarking;

determining an allowed phase change value for the phase of said current frequency bin, according to a reference angle to be embedded in that current frequency bin, which reference angle is derived from a watermark pattern;

changing the phase of said current frequency bin according to said allowed phase change value;

based on said masking threshold and said allowed phase change value, calculating an allowed magnitude change value for said current frequency bin, and calculating from the audio quality level value a magnitude change scaling factor;

calculating a scaled allowed magnitude change values from said allowed magnitude change value and said scaling factor;

increasing the magnitude of said current frequency bin by said scaled allowed magnitude change values;

embedding said watermark into said current frequency bin with said changed phase and said increased magnitude; and providing the correspondingly watermarked current frequency bin suitable for acoustic reception and watermark detection in the presence of surrounding noise.

2. The method according to claim 1, wherein no phase changes are carried out for frequency bins representing a frequency smaller than a first frequency threshold value and for frequency bins representing a frequency greater than a second frequency threshold value that is greater than said first frequency threshold value.

3. The method according to claim 1, wherein a magnitude change value for said current frequency bin is denoted $\delta X[i]$ and $\delta X[i]=\sqrt{LT_g[i]^2-X[i]^2+(X[i]\cos(\delta\varphi[i]))^2}-X[i]+X[i]\cos(\delta\varphi[i])$, where $LT_g[i]$ is said current masking threshold, $X[i]$ is the original magnitude of said current frequency bin, and $\delta\varphi[i]$ is said current phase change value.

4. The method according to claim 1, wherein said magnitude change scaling factor is denoted $f$ and $f=10^{-masking_CurveOffset/20}$, where $$maskingCurveOffset = \frac{100-\text{level}}{100}\times 30 \ \text{[dB]}$$

and level has a value between '0' and '100' and is said audio quality level value, with level=100 for the best audio quality.

5. An apparatus for increasing the strength of phase-based watermarking of an audio signal, which watermarked audio signal is suitable for acoustic reception and watermark detection in the presence of surrounding noise, said apparatus including means adapted to:

receiving said audio signal;

determining a masking threshold for a phase change based watermarking of a current frequency bin in a frequency/phase representation of said audio signal, wherein said masking threshold determination is controlled by a received audio quality level value representing the audio quality following said audio signal watermarking;

determining an allowed phase change value for the phase of said current frequency bin, according to a reference angle to be embedded in that current frequency bin, which reference angle is derived from a watermark pattern;

changing the phase of said current frequency bin according to said allowed phase change value;

based on said masking threshold and said allowed phase change value, calculating an allowed magnitude change value for said current frequency bin, and calculating from the audio quality level value a magnitude change scaling factor;

calculating a scaled allowed magnitude change values from said allowed magnitude change value and said scaling factor;

increasing the magnitude of said current frequency bin by said scaled allowed magnitude change values;

embedding said watermark into said current frequency bin with said changed phase and said increased magnitude; and providing the correspondingly watermarked current frequency bin suitable for acoustic reception and watermark detection in the presence of surrounding noise.

6. The apparatus according to claim 5, wherein no phase changes are carried out for frequency bins representing a frequency smaller than a first frequency threshold value and for frequency bins representing a frequency greater than a second frequency threshold value that is greater than said first frequency threshold value.

7. The apparatus according to claim 5, wherein a magnitude change value for said current frequency bin is denoted δX[i] and $$\delta X[i]=\sqrt{LT_g[i]^2-X[i]^2+(X[i]cos(\delta\varphi[i]))^2}-X[i]+X[i]\cos(\delta\varphi[i]),$$

where $LT_g[i]$ is said current masking threshold, X[i] is the original magnitude of said current frequency bin, and δφ[i] is said current phase change value.

8. The apparatus according to claim 5, wherein said magnitude change scaling factor is denoted $f$ and $f=10^{-maskingCurveOffset/20}$, where $$maskingCurveOffset=\frac{100-\text{level}}{100}\times 30\ \text{[dB]}$$

and level has a value between '0' and '100' and is said audio quality level value, with level=100 for the best audio quality.

9. A non-transitory processor readable storage medium that contains or stores, or has recorded on it, a digital audio bitstream, said digital audio bitstream including a watermark embedded therein according to:

determining a masking threshold for a phase change based watermarking of a current frequency bin in a frequency/phase representation of said audio signal, wherein said masking threshold determination is controlled by a received audio quality level value representing the audio quality following said audio signal watermarking;

determining an allowed phase change value for the phase of said current frequency bin, according to a reference angle to be embedded in that current frequency bin, which reference angle is derived from a watermark pattern;

changing the phase of said current frequency bin according to said allowed phase change value;

based on said masking threshold and said allowed phase change value, calculating an allowed magnitude change value for said current frequency bin, and calculating from the audio quality level value a magnitude change scaling factor;

calculating a scaled allowed magnitude change values from said allowed magnitude change value and said scaling factor;

increasing the magnitude of said current frequency bin by said scaled allowed magnitude change values;

embedding said watermark into said current frequency bin with said changed phase and said increased magnitude to produce a watermarked digital audio bitstream suitable for acoustic reception and watermark detection in the presence of surrounding noise.

* * * * *